US010436078B2

(12) United States Patent
Miyashita

(10) Patent No.: US 10,436,078 B2
(45) Date of Patent: Oct. 8, 2019

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Shigeki Miyashita, Susono (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 22 days.

(21) Appl. No.: 15/947,535

(22) Filed: Apr. 6, 2018

(65) Prior Publication Data

US 2018/0291775 A1 Oct. 11, 2018

(30) Foreign Application Priority Data

Apr. 11, 2017 (JP) ..... 2017-078422

(51) Int. Cl.

| | |
|---|---|
| ***F01L 13/00*** | (2006.01) |
| ***F02D 13/00*** | (2006.01) |
| ***F02D 41/04*** | (2006.01) |
| *F02D 41/06* | (2006.01) |
| *F02D 41/00* | (2006.01) |

(52) U.S. Cl.

CPC ..... *F01L 13/0015* (2013.01); *F02D 13/00* (2013.01); *F02D 41/042* (2013.01); *F01L 2800/01* (2013.01); *F01L 2800/03* (2013.01); *F01L 2820/044* (2013.01); *F02D 41/064* (2013.01); *F02D 2041/001* (2013.01); *F02D 2200/021* (2013.01); *F02D 2200/0414* (2013.01); *F02D 2200/70* (2013.01)

(58) Field of Classification Search

CPC . F01L 1/20; F01L 1/46; F01L 13/0015; F01L 2201/00; F01L 2800/03; F01L 2800/16; F01L 2820/044

USPC ..... 123/90.1, 90.19

See application file for complete search history.

(56) References Cited

U.S. PATENT DOCUMENTS 6,463,896 B1 * 10/2002 Fujiwara ..... F01L 9/04 123/90.11

7,509,939 B2 3/2009 Asano et al.

(Continued)

FOREIGN PATENT DOCUMENTS

CN 100439678 C 12/2008

JP 2008-088835 A 4/2008

(Continued)

*Primary Examiner* — Jorge L Leon, Jr.

(74) *Attorney, Agent, or Firm* — Sughrue Mion, PLLC

(57) ABSTRACT

In a control device for an engine, the engine includes combustion chambers, ports connected to the combustion chambers, and valves that open and close areas between the combustion chambers and the ports. The control device includes an electronic control unit that is configured to execute an anti-freezing operation of performing control to fully close the valves or make the valves be in a state of being opened with a lift amount of 1 mm or more, in a case where temperatures around the valves are lowered to a predetermined temperature range after the engine is stopped, or in a case where an outside air temperature when the engine is stopped is equal to or lower than a predetermined temperature. The predetermined temperature range is a temperature range in which an upper limit value is lower than 10° C., and the predetermined temperature is lower than 5° C.

14 Claims, 9 Drawing Sheets

(56) References Cited

U.S. PATENT DOCUMENTS

| | | | | |
|---|---|---|---|---|
| 2007/0017482 | A1 | 1/2007 | Nakashima et al. | |
| 2007/0163531 | A1* | 7/2007 | Lewis | F01L 9/02 123/179.4 |
| 2008/0078356 | A1 | 4/2008 | Akagawa | |
| 2010/0012086 | A1* | 1/2010 | Demura | F02D 13/0219 123/399 |
| 2015/0274153 | A1 | 10/2015 | Kanai | |
| 2016/0245219 | A1 | 8/2016 | Kiani et al. | |

FOREIGN PATENT DOCUMENTS

| | | | | |
|---|---|---|---|---|
| JP | 2012-127246 | A | | 7/2012 |
| JP | 2014-51153 | A | | 3/2014 |
| JP | 2014051153 | A | * | 3/2014 |
| JP | 2015-182671 | A | | 10/2015 |
| JP | 2017-2725 | A | | 1/2017 |
| JP | 2017002725 | A | * | 1/2017 |

* cited by examiner

CONTROL DEVICE FOR INTERNAL COMBUSTION ENGINE

INCORPORATION BY REFERENCE

The disclosure of Japanese Patent Application No. 2017-078422 filed on Apr. 11, 2017 including the specification, drawings and abstract is incorporated herein by reference in its entirety.

BACKGROUND

1. Technical Field

The present disclosure relates to a control device for an internal combustion engine and specifically, to a control device suitable for use in an internal combustion engine in which condensed water is generated at a port or flows into the port.

2. Description of Related Art

In Japanese Unexamined Patent Application Publication No. 2008-088835 (JP 2008-088835 A), a problem that moisture condensed around a throttle freezes after an internal combustion engine is stopped, so that the throttle is fixed, and a solution to the problem are described. However, the freezing which is caused by condensed water is not a problem limited to the throttle. There is a case where the condensed water also reaches a valve that opens and closes an area between a combustion chamber and a port connected to the combustion chamber, that is, an intake valve or an exhaust valve. When the intake valve or the exhaust valve is opened with a halfway degree of opening, the condensed water is accumulated between a valve face and a valve seat by the action of the surface tension of the condensed water. In a case where the condensed water freezes, the valve is not completely closed at the time of the next starting of the internal combustion engine, and thus there is a possibility that misfire may occur due to insufficient fresh air or excessive residual gas due to exhaust failure.

SUMMARY

The present disclosure provides a control device for an internal combustion engine, which allows condensed water in a port to be restrained as much as possible from freezing in a gap between a valve face and a valve seat of a valve that opens and closes an area between a combustion chamber and the port connected to the combustion chamber, after the internal combustion engine is stopped.

An aspect of the present disclosure relates to a control device for an internal combustion engine. The internal combustion engine includes combustion chambers, ports connected to the combustion chambers, and valves configured to open and close areas between the combustion chambers and the ports. The control device includes an electronic control unit configured to execute an anti-freezing operation of performing control to fully close the valves or make the valves be in a state of being opened with a lift amount of 1 mm or more, in a case where temperatures around the valves are lowered to a predetermined temperature range after the internal combustion engine is stopped, or in a case where an outside air temperature when the internal combustion engine is stopped is equal to or lower than a predetermined temperature. The predetermined temperature range is a temperature range in which an upper limit value is lower than 10° C., and the predetermined temperature is lower than 5° C.

In a case where the valve is fully closed, a gap is not formed between a valve face and a valve seat, and therefore, condensed water does not accumulate in the gap. Further, in a case where the valve is opened with a lift amount of 1 mm or more, the surface tension acting on the condensed water is weakened, and thus the condensed water drips down into the cylinder from between the valve face and the valve seat. According to the aspect of the present disclosure, the above-described valve operation is performed before the temperature around the valve becomes equal to or lower than 0° C., whereby the condensed water can be restrained as much as possible from freezing in the gap between the valve face and the valve seat.

When the temperature around the valve becomes lower than 10° C. after the internal combustion engine is stopped, due to the subsequent decrease in temperature, there is a possibility that the temperature around the valve may become equal to or lower than the freezing temperature of the condensed water. Even in a case where the outside air temperature when the internal combustion engine is stopped is lower than 5° C. due to the subsequent decrease in outside air temperature, there is a possibility that the temperature around the valve may become equal to or lower than the freezing temperature of the condensed water. That is, each of the fact that the temperature around the valve has been lowered to the predetermined temperature range after the internal combustion engine is stopped and the fact that the outside air temperature when the internal combustion engine is stopped is equal to or lower than the predetermined temperature is a condition for determining the possibility of having the temperature around the valve become equal to or lower than the freezing temperature of the condensed water in the future.

In a case where the execution of the anti-freezing operation is determined based on the temperature around the valve after the internal combustion engine is stopped, in the aspect of the present disclosure, the electronic control unit may be configured to perform control to fully close the valves, as the anti-freezing operation, in a case where the valves are opened before the temperatures around the valves are lowered to the predetermined temperature range. According to the aspect of the present disclosure, even in a case where water droplets have adhered to the valve seat or the valve face, the water droplets can be sandwiched and squashed between the valve face and the valve seat. On the other hand, in the aspect of the present disclosure, the electronic control unit may be configured to perform control to open the valves with a lift amount of 1 mm or more, as the anti-freezing operation, in a case where the valves are fully closed before the temperatures around the valves are lowered to the predetermined temperature range. According to the aspect of the present disclosure, it is possible to drop the condensed water accumulated on the valve head in the port into the cylinder from the gap between the valve face and the valve seat, which is formed when the valve is opened.

In the aspect of the present disclosure, the electronic control unit may be configured to perform control to open the valves at least once and then fully close the valves, as the anti-freezing operation, in a case where the valves are fully closed before the temperatures around the valves are lowered to the predetermined temperature range. According to the aspect of the present disclosure, by temporarily opening the valve that is in the fully closed state, it is possible to drop the condensed water accumulated on the valve head in the port into the cylinder from the gap between the valve face and the valve seat, which is formed when the valve is opened, and by fully closing the opened valve again, it is possible to squash water droplets adhered to the valve seat and the valve face.

In a case where the execution of the anti-freezing operation is determined based on the outside air temperature when the internal combustion engine is stopped, in the aspect of the present disclosure, the electronic control unit may be configured to execute the anti-freezing operation at a timing when the internal combustion engine is stopped, in a case where the outside air temperature when the internal combustion engine is stopped is equal to or lower than the predetermined temperature. According to the aspect of the present disclosure, when it is at the timing when the internal combustion engine is stopped, it is possible to relate the anti-freezing operation to the stop position control of the internal combustion engine. That is, it is possible to control a stopping crank angle of the internal combustion engine such that the valve is fully closed or is in a state of being opened with a lift amount of 1 mm or more.

In the aspect of the present disclosure, the electronic control unit may be configured to perform control to fully close the valves, as the anti-freezing operation, after a predetermined time has elapsed from the stop of the internal combustion engine, in a case where the outside air temperature when the internal combustion engine is stopped is equal to or lower than the predetermined temperature and the valves are opened when the internal combustion engine is stopped. This is because the condensed water generated due to a decrease in the temperature in the port or the condensed water flowing to the port by free fall is also present considerably after the internal combustion engine is stopped. According to the aspect of the present disclosure, even in a case where water droplets have adhered to the valve seat or the valve face, the water droplets can be sandwiched and squashed between the valve face and the valve seat. On the other hand, in the aspect of the present disclosure, the electronic control unit may be configured to perform control to open the valves with a lift amount of 1 mm or more, as the anti-freezing operation, after a predetermined time has elapsed from the stop of the internal combustion engine, in a case where the outside air temperature when the internal combustion engine is stopped is equal to or lower than the predetermined temperature and the valves are fully closed when the internal combustion engine is stopped. According to the aspect of the present disclosure, the condensed water accumulated on the valve head in the port can be dropped into the cylinder from the gap between the valve face and the valve seat, which is formed when the valve is opened.

In the aspect of the present disclosure, the electronic control unit may be configured to perform control to open the valves at least once and then fully close the valves, as the anti-freezing operation, in a case where the outside air temperature when the internal combustion engine is stopped is equal to or lower than the predetermined temperature and the valves are fully closed when the internal combustion engine is stopped. According to the aspect of the present disclosure, by temporarily opening the valve in the fully closed state, it is possible to drop the condensed water accumulated on the valve head in the port into the cylinder from the gap between the valve face and the valve seat, which is formed when the valve is opened. Further, by fully closing the opened valve again, it is possible to squash water droplets adhered to the valve seat or the valve face.

In the aspect of the present disclosure, the electronic control unit may be configured to estimate the amount of condensed water that is present in the ports when the internal combustion engine is stopped or after the internal combustion engine is stopped. The electronic control unit may be configured to change control of the valves according to the amount of the condensed water, as the anti-freezing operation. For example, the lift amount of the valve may be set to be larger as the estimated amount of the condensed water is larger. According to the aspect of the present disclosure, it is possible to more reliably drop the condensed water from the gap between the valve face and the valve seat.

In the aspect of the present disclosure, the electronic control unit may be configured to execute the anti-freezing operation in a case where the amount of the condensed water is greater than a predetermined upper limit amount. A problem in that the condensed water freezes in the gap between the valve face and the valve seat does not occur in a case where the amount of the condensed water is equal to or less than the predetermined upper limit amount. According to the aspect of the present disclosure, in a case where the amount of the condensed water is equal to or less than the upper limit amount, the anti-freezing operation is not executed, whereby energy consumption can be suppressed as much as possible.

In the aspect of the present disclosure, the electronic control unit may be configured to perform control to fully close the valves or make the valves be in a state of being opened with a lift amount of 1 mm or more, as the anti-freezing operation, in a case where the amount of the condensed water is greater than the upper limit amount and equal to or less than a first reference amount that is greater than the upper limit amount. The electronic control unit may be configured to perform control to open the valves at least once and then fully close the valves, as the anti-freezing operation, in a case where the amount of the condensed water is greater than the first reference amount. An efficient valve operation differs according to the amount of condensed water, and therefore, according to the aspect of the present disclosure, by changing the operation of the valve according to the amount of the condensed water as described above, it is possible to suppress energy consumption for the anti-freezing operation as much as possible.

In the aspect of the present disclosure, the electronic control unit may be configured to perform control to fully close the valves, as the anti-freezing operation, in a case where the amount of the condensed water is equal to or less than the first reference amount and is greater than a second reference amount smaller than the first reference amount. In a case where the amount of the condensed water increases to some extent, the probability of the condensed water adhering to the valve seat or the valve face when the valve is opened is further increased. According to the aspect of the present disclosure, by setting the second reference amount between the upper limit amount and the first reference amount and fully closing the valve when the amount of the condensed water becomes greater than the second reference amount, the condensed water can be restrained as much as possible from freezing in the gap between the valve face and the valve seat.

In the aspect of the present disclosure, the internal combustion engine may have a plurality of valves having different mounting angles with respect to a horizontal plane. The electronic control unit may be configured to make control of the valves different according to the mounting angles, as the anti-freezing operation. This is because the ease with which the condensed water drips down when the valve is opened differs according to the mounting angle of the valve. When the lift amount of the valve is the same, the condensed water more easily drips down as the mounting angle of the valve is closer to being horizontal, and it becomes difficult for the condensed water to drip down as the mounting angle of the valve is closer to being vertical. Therefore, for example, the lift amount of the valve may be set to be larger as the mounting angle of the valve is closer to being vertical. According to the aspect of the present disclosure, it is possible to more reliably drop the condensed water from the gap between the valve face and the valve seat. Further, the operation of the valve in the anti-freezing operation may be made different according to the amount of the condensed water and the mounting angle.

In the aspect of the present disclosure, the electronic control unit may be configured to estimate the temperatures around the valves, based on an outside air temperature. The electronic control unit may be configured to estimate the temperatures around the valves, based on an engine temperature when the internal combustion engine is stopped, an outside air temperature, and an elapsed time after the internal combustion engine is stopped. The electronic control unit may be configured to estimate the temperatures around the valves, based on an output of a temperature sensor provided inside the internal combustion engine.

In the aspect of the present disclosure, the electronic control unit may be configured to determine a possibility of freezing after the internal combustion engine is stopped, based on information obtained by communication with the outside, and may be configured to estimate the temperatures around the valves after the internal combustion engine is stopped, solely in a case where the electronic control unit determines that there is a possibility of freezing. According to the aspect of the present disclosure, in a case where there is no possibility of freezing, estimation of the temperature around the valve is not performed, whereby energy consumption can be suppressed as much as possible.

As described above, with the control device for an internal combustion engine according to the aspect of the present disclosure, the condensed water in the port can be restrained as much as possible from freezing in the gap between the valve face and the valve seat of the valve that opens and closes an area between the combustion chamber and the port connected to the combustion chamber, after the internal combustion engine is stopped.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, an embodiment of the present disclosure will be described with reference to the drawings. However, the embodiment described below is for exemplifying a device or a method for embodying the technical idea of the present disclosure, and unless otherwise specified, there is no intention to limit the structures or disposition of constituent parts, a processing order, or the like to the following. The present disclosure is not limited to the embodiment described below, and various modifications can be made within a scope that does not depart from the gist of the present disclosure.

1. Configuration of Premised Internal Combustion Engine

Figure 1:
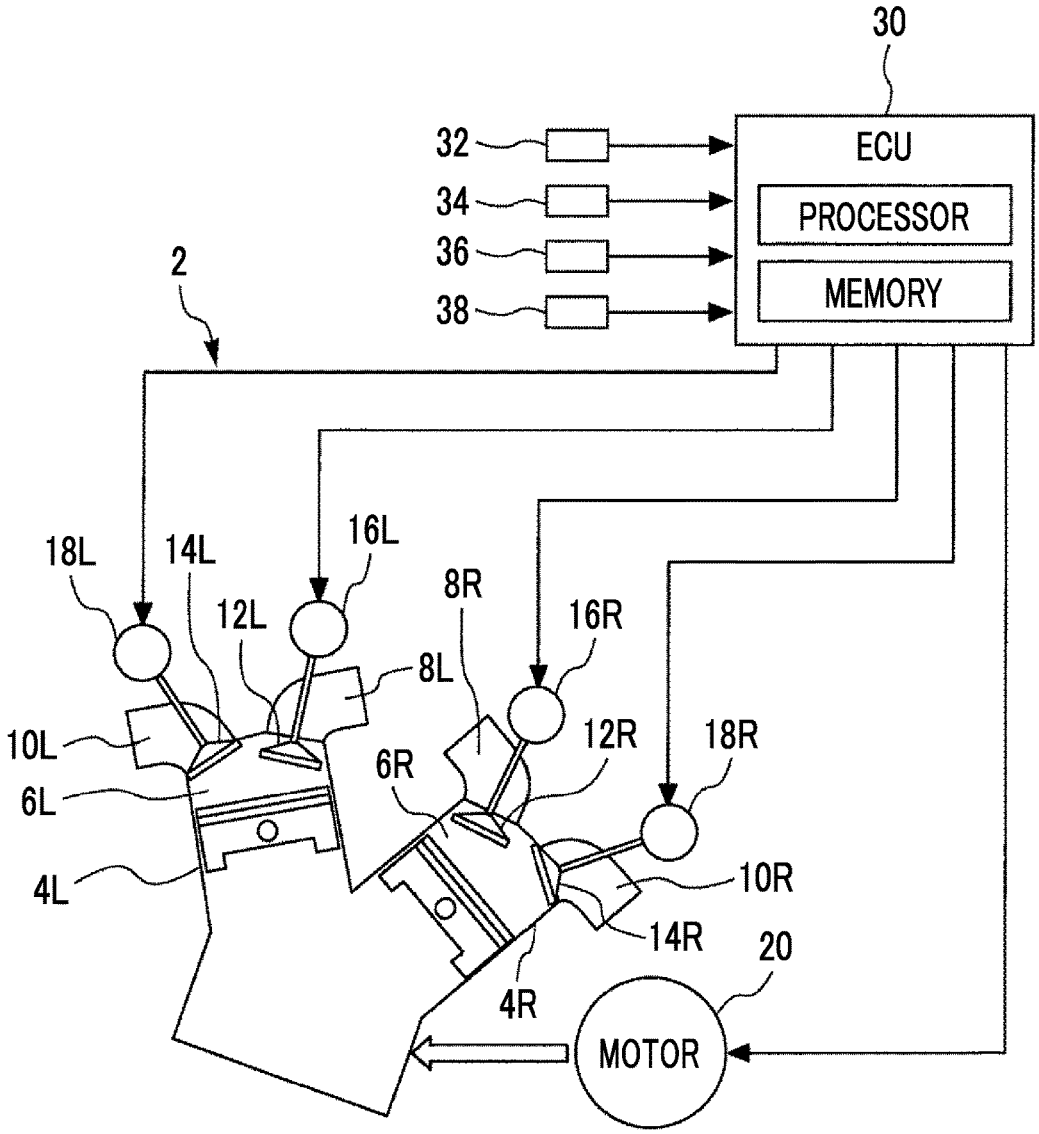
FIG. 1 is a diagram showing a configuration of an internal combustion engine of an embodiment of the present disclosure.

FIG. 1 is a diagram showing the configuration of an internal combustion engine of an embodiment of the present disclosure. An internal combustion engine 2 of this embodiment is a V-type six-cylinder engine (hereinafter simply referred to as an engine). There is no limitation on a combustion system of the engine 2, and the engine 2 may be configured as a spark ignition type engine or as a diesel engine, for example. In this embodiment, a vehicle on which the engine 2 is mounted is a front-engine and front-drive (FF) vehicle. The engine 2 is mounted transversely and is to be inclined forward at a front portion of the vehicle. A bank that is located on the front side of the vehicle, out of two banks 4L, 4R of the engine 2, is a right bank 4R, and a bank that is located on the rear side of the vehicle is a left bank 4L. In this embodiment, the bank angle between the right bank 4R and the left bank 4L is 60 degrees.

Intake ports 8L, 8R and exhaust ports 10L, 10R communicating with combustion chambers 6L, 6R of the respective cylinders are provided for each cylinder in cylinder heads of the respective banks 4L, 4R. In the respective banks 4L, 4R, the intake ports 8L, 8R are provided on the inside of the engine 2, and the exhaust ports 10L, 10R are provided on the outside of the engine 2. An area between each of the combustion chambers 6L, 6R and each of the intake ports 8L, 8R, and an area between each of the combustion chambers 6L, 6R and each of the exhaust ports 10L, 10R are opened and closed by valves 12L, 12R, 14L, 14R, respectively. Valve drive mechanisms 16L, 16R for driving the intake valves 12L, 12R that are valves on the intake side, and valve drive mechanisms 18L, 18R for driving the exhaust valves 14L, 14R that are valves on the exhaust side are mechanical type variable valve drive mechanisms to which a driving force is distributed from a crankshaft of the engine 2. In the following description, with respect to parts or portions that are provided in each of the right bank 4R and the left bank 4L, in a case where it is not needed to particularly distinguish the right and left, letter L or R of the reference numeral is omitted.

In this embodiment, the vehicle on which the engine 2 is mounted is a hybrid vehicle that uses a motor 20 together with the engine 2, as a power unit. In this hybrid vehicle, the engine 2 can be rotated by the motor 20 by switching a driving force transmission path between the engine 2, the motor 20, and a driving force transmission mechanism (not shown). The forced rotation of the engine 2 by the motor 20 is used not only in a case of starting the engine 2 but also when stopping the engine 2 in a case where a predetermined condition is satisfied. This will be described later.

The control of the engine 2 is performed by a control device 30. The control device 30 is configured of an electronic control unit (ECU) having at least one processor and at least one memory. Various types of data that include various programs or maps for controlling the engine 2 are stored in the memory. The program stored in the memory is loaded and executed by the processor, whereby various functions are realized in the control device 30. The control device 30 may be composed of a plurality of ECUs.

Various types of information about the operating state or operating conditions of the engine 2 are input from various sensors mounted on the engine 2 or the vehicle to the control device 30. For example, information about an outside air temperature is input from an outside air temperature sensor 32 mounted on a portion that is not affected by the heat from the engine 2 of the vehicle. Information about an intake air temperature is input from an intake air temperature sensor 34 mounted on an intake passage inlet or the surge tank of the engine 2. Information about a cooling water temperature of the engine 2 is input from a water temperature sensor 36. Information about a crank angle of the engine 2 is input from a crank angle sensor 38. The control device 30 determines the operation amount of an actuator related to the operation of the engine 2, based on at least these types of information described above. In addition to the variable valve drive mechanisms 16, 18, a fuel injection device (not shown), a throttle, an ignition device, or the like is included in the actuator. The motor 20 capable of forcibly rotating the engine 2 is also included in one of the actuators.

2. Problems Caused by Condensed Water

One of problems in the engine 2 configured as described above is condensed water that is present in the ports 8, 10 after the engine 2 is stopped. In the case of the exhaust port 10, since a wall surface temperature of the exhaust port 10 is lower than the dew point temperature of the exhaust gas for some time after the start of the engine 2, moisture contained in the exhaust gas condenses on the wall surface of the exhaust port 10 to become condensed water. Due to the above, in a case where the engine 2 is stopped before warming-up is completed, the condensed water remains to adhere to the exhaust port 10 and flows to the exhaust valve 14.

Figure 2:
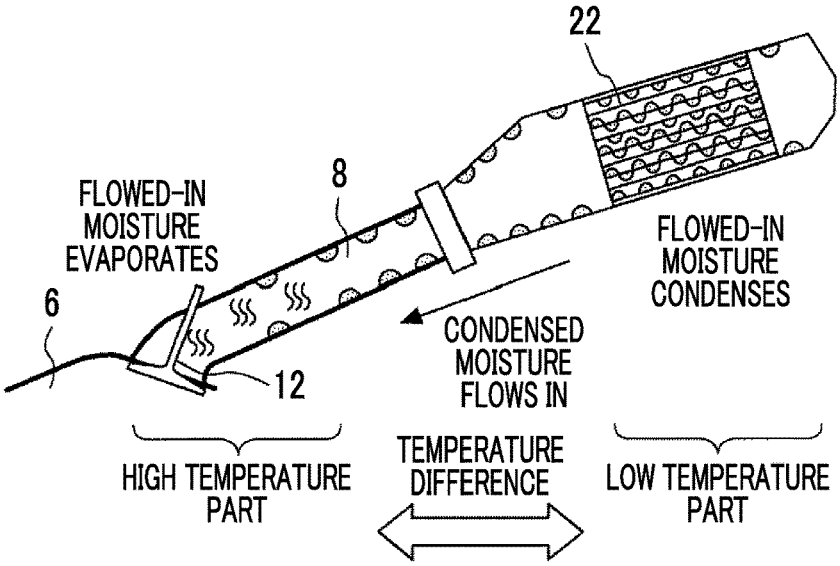
FIG. 2 is a diagram for describing the behavior of water in an intake system immediately after the internal combustion engine is stopped.

In the case of the intake port 8, condensed water is generated by moisture contained in EGR gas or blow-by gas, or moisture contained in fresh air. In particular, in a case where the engine 2 is a supercharged engine that is provided with an intercooler, condensed water is easily generated in the intercooler. FIG. 2 is a diagram for describing the behavior of water in an intake system immediately after the engine 2 provided with an intercooler 22 is stopped. As shown in FIG. 2, after the engine 2 is stopped, moisture contained in gas in the intercooler 22 condenses due to the lowering of the wall surface temperature of the intercooler 22, so that condensed water is generated. The condensed water generated in the intercooler 22 drips down to the intake port 8. However, since the intake port 8 remains at a high temperature for some time after the engine 2 is stopped, the condensed water evaporates at the intake port 8. The evaporated moisture condenses again in the intercooler 22 having a low temperature, thereby becoming condensed water, and the condensed water flows to the intake port 8 again. This is repeated until the temperature difference between the intercooler 22 and the intake port 8 becomes small. Then, when the temperature of the intake port 8 is lowered, so that the evaporation at the intake port 8 stops, the condensed water flows to the intake valve 12.

When the engine 2 is being stopped, as a matter of course, the respective valves 12, 14 are also being stopped. The degree of opening of each of the valves 12, 14 when the engine 2 is being stopped is determined according to the stop position of the crankshaft and differs according to the cylinder. For example, there is also a fully-closed valve, there is also a fully-open valve, and there is also a valve opened with a minute degree of opening. When the condensed water has flowed to the valves 12, 14, as described above, in the fully-closed valve, the condensed water accumulates on the valve head. In the valve with a relatively large degree of opening, the condensed water drips down into the cylinder from the gap between a valve face and a valve seat. However, depending on the amount of condensed water, there is a case where the condensed water remains as water droplets in the gap between the valve face and the valve seat. In the valve with a relatively small degree of opening, the condensed water stays without dripping down from the gap between the valve face and the valve seat. The condensed water that remains around each of the valves 12, 14 becomes ice by being frozen when the temperature around each of the valves 12, 14 is lowered to a temperature equal to or lower than the freezing temperature of the condensed water (here, the freezing temperature of the condensed water is assumed to be 0° C.).

The ice formed by freezing of the condensed water around the valves 12, 14 affects startability when the engine 2 is restarted. For example, in a case where the condensed water has frozen in the gap between the valve face and the valve seat, closing failure occurs in which the valves 12, 14 are not completely closed. Even in a case where the valves 12, 14 are completely closed, when there is a large amount of condensed water accumulated on the valve head, a gas passage is blocked due to the formation of a block of ice on the valve head, resulting in a decrease in intake and exhaust function. Therefore, in order to secure good startability of the engine 2 even in an environment where the condensed water freezes, at least the freezing of the condensed water in the gap between the valve face and the valve seat and the freezing of a large amount of condensed water on the valve head need to be restrained as much as possible.

3. Measures Against Freezing of Condensed Water

The inventors of this application performed a study on the condition of the freezing of the condensed water in the gap between the valve face and the valve seat. As a result of the study, it was found that whether or not the condensed water freezes in the gap between the valve face and the valve seat is determined by the relationship between the amount of condensed water, the degree of opening of the valve, and the mounting angle of the valve with respect to the horizontal plane. Hereinafter, the facts that have been found will be described.

Figure 3:
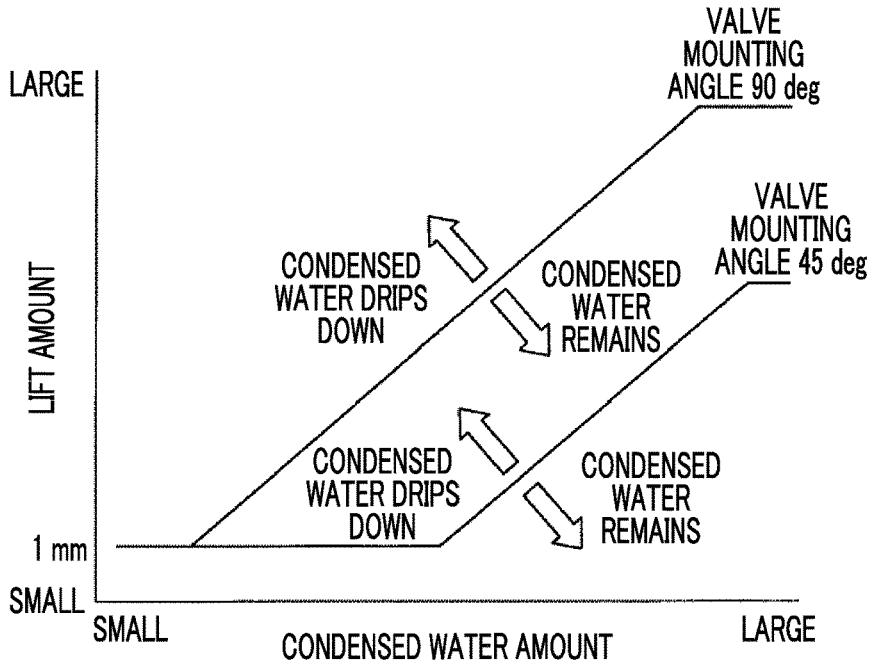
FIG. 3 is a graph showing a relationship between a mounting angle of a valve, the amount of condensed water accumulated on a valve head, and the lift amount of the valve needed for the condensed water to drip down.

In a case where the valve is fully closed, naturally, the condensed water does not freeze in the gap between the valve face and the valve seat. A problem arises when the valve is open. FIG. 3 is a graph showing the relationship between the mounting angle of the valve, the amount of the condensed water accumulated on the valve head, and the lift amount of valve needed for the condensed water to drip down, which is statistically obtained from the experiment results. As shown in FIG. 3, in a case where the mounting angle of the valve is constant, it is found that in a case where the amount of the condensed water is large, the needed lift amount of the valve becomes large. Further, in a case where the amount of the condensed water is constant, it is found that the needed lift amount of the valve becomes larger as the mounting angle of the valve is closer to 90 degrees. This is because the condensed water drips down more easily as the mounting angle of the valve is closer to being horizontal and it becomes more difficult for the condensed water to flow down as the mounting angle of the valve is closer to being vertical.

From the experiment results, it was found that there is a minimum lift amount that allows the condensed water to flow down. The minimum lift amount statistically obtained from the experiment results is 1 mm. In a case where the lift amount is smaller than 1 mm, the condensed water stably remains between the valve face and the valve seat due to the action of the surface tension, regardless of the magnitude of the mounting angle of the valve. Therefore, in a case where an attempt to allow the condensed water to flow down by opening the valve is made, it is needed to open the valve with the lift amount of at least 1 mm or more.

In a case where the lift amount of the valve becomes large to some extent, the condensed water drips down into the cylinder without staying, and therefore, it was also found that even in a case where the amount of the condensed water increases, it is not needed to increase the lift amount any more. The lift amount at this time also differs according to the mounting angle of the valve. In a case where the mounting angle of the valve is vertical, the lift amount is 3.5 mm, and the needed lift amount becomes smaller as the mounting angle of the valve is closer to being horizontal.

However, in a case where the amount of the condensed water increases, the amount of the condensed water that adheres to the valve seat or the valve face in the state of water droplets when the valve is opened also increases accordingly. For this reason, when the amount of the condensed water becomes equal to or greater than a certain amount, it is not possible to restrain the condensed water from remaining in the gap between the valve face and the valve seat merely by opening the valve. In the experiments performed by the inventors of this application, the upper limit of the amount of the condensed water that is effective due to opening of the valve was about 0.1 cc per cylinder (in a relationship with the claims, the condensed water amount that is 0.1 cc corresponds to a second reference amount).

The inventors of this application performed a study on the influence of the amount of the condensed water staying on the valve head in the port in a case where the valve is fully closed. As a result of the study, it was found that in a case where the amount of the condensed water has reached an amount equal to or greater than a certain amount, a decrease in the intake and exhaust function becomes more remarkable due to the blocking of the gas passage due to the freezing of the condensed water. In the experiments performed by the inventors of this application, the amount of condensed water in which the freezing starts to significantly affect the intake and exhaust function was about 1 cc per cylinder (in a relationship with the claims, the condensed water amount that is 1 cc corresponds to a first reference amount). The experiment result obtained here means that in a case where the amount of condensed water is greater than about 0.1 cc per cylinder and less than about 1 cc, fully closing the valve is the most effective way of not having condensed water to remain in the gap between the valve face and the valve seat.

The inventors of this application examined measures in a case where the amount of condensed water is excessively large. In the experiments performed by the inventors of this application, an excessively large amount of condensed water means condensed water in an amount exceeding 1 cc per cylinder. As a result of various experiments, it was found that in a case where the amount of condensed water is large, it is more effective to temporarily open the valve and then fully close the valve again, rather than to maintain the valve in a fully closed state. Due to temporarily opening the valve, the condensed water accumulated on the valve head in the port drips down into the cylinder. Then, due to fully closing the opened valve again, water droplets adhered to the valve seat or the valve face can be sandwiched and squashed between the valve seat and the valve face.

As described above, the following three facts were found from the results of the study performed by the inventors of this application. The first is that in a case where the amount of condensed water is small, for example, in a case where the amount of condensed water is less than about 0.1 cc per cylinder, the purpose of causing the condensed water not to remain in the gap between the valve face and the valve seat can be achieved by fully closing the valve or opening the valve with the lift amount of at least 1 mm or more. However, in order to make the condensed water more reliably drop from the gap between the valve face and the valve seat, it is better to increase the lift amount of the valve as the mounting angle of the valve is closer to being vertical. The second is that in a case where the amount of condensed water is large, for example, in a case where the amount of condensed water is greater than about 0.1 cc per cylinder and less than about 1 cc, the purpose of causing the condensed water not to remain in the gap between the valve face and the valve seat can be achieved by fully closing the valve. The third is that in a case where the amount of condensed water is excessively large, for example, in a case where the amount of condensed water exceeds about 1 cc per cylinder, the purpose of causing the condensed water not to remain in the gap between the valve face and the valve seat while restraining the gas passage from being blocked by the frozen condensed water can be achieved by temporarily opening the valve and then closing the valve again, rather than maintaining the valve in a fully closed state. The valve operations described above are operations for restraining the condensed water from freezing in the gap between the valve face and the valve seat, and therefore, hereinafter, the valve operations described above are collectively referred to as an anti-freezing operation.

4. Specific Example of Anti-Freezing Operation

A program for executing the above-described anti-freezing operation in a case where there is a possibility that condensed water may be generated around the valves 12, 14 after the engine 2 is stopped is incorporated into the control device 30 shown in FIG. 1. The program is executed by the processor, whereby the control device 30 functions as anti-freezing operation means. The contents of the anti-freezing operation have been described so far. However, hereinafter, a specific operation when the anti-freezing operation is executed by the control device 30 will be described with an example.

Figure 4:
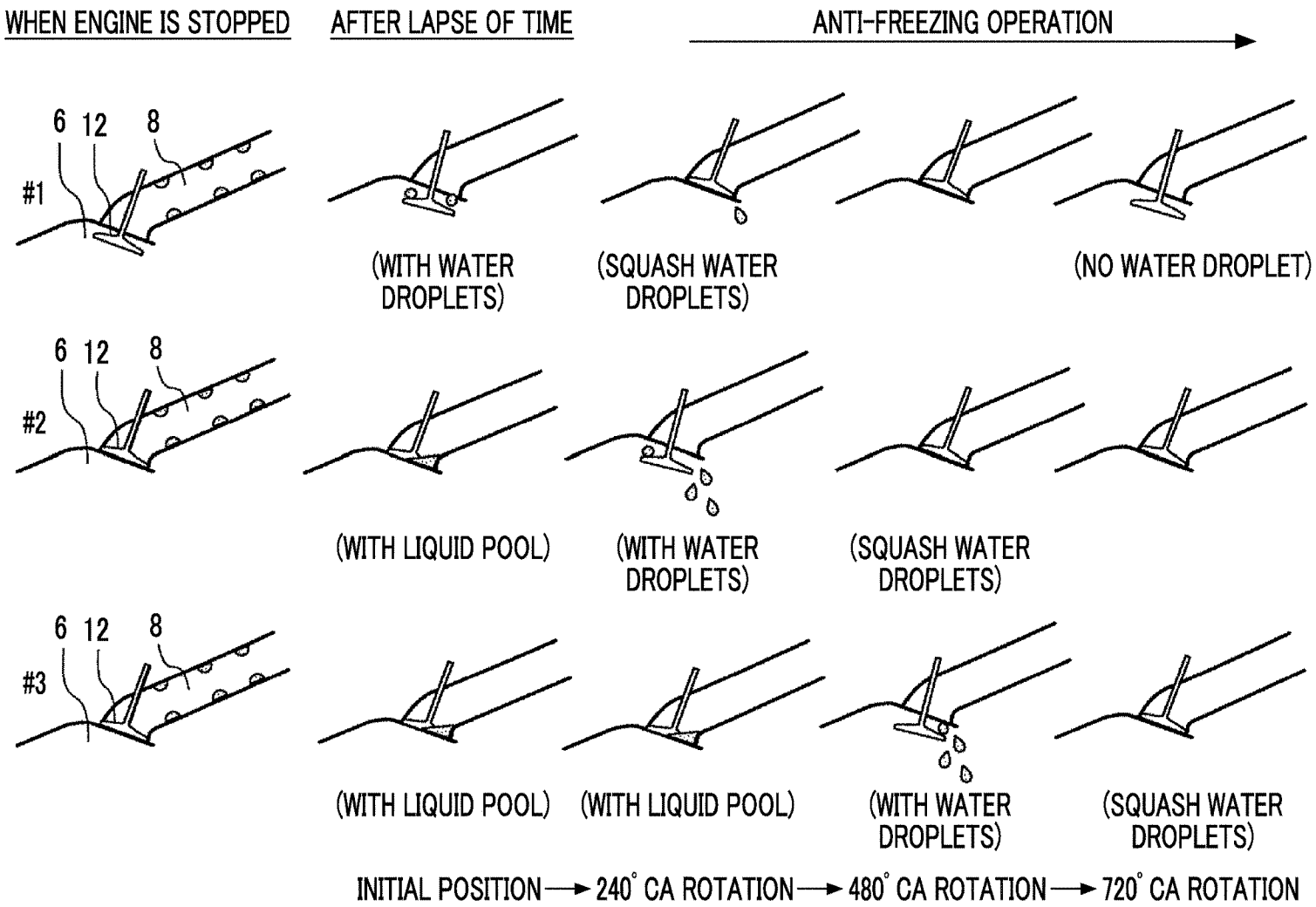
FIG. 4 is a diagram showing an example of an anti-freezing operation.

FIG. 4 is a diagram showing an example of the anti-freezing operation that is executed by the control device 30. In FIG. 4, the operations of the intake valves 12 in a first cylinder #1, a second cylinder #2, and a third cylinder #3 of one of the banks are drawn along a time axis. The phase difference between the cylinders is 240 degrees. In the example described above, when the engine 2 is stopped, the intake valve 12 of the first cylinder #1 is opened and the intake valves 12 of the second cylinder #2 and the third cylinder #3 are closed. The lift amount of the intake valve 12 of the first cylinder #1 that is open is at least 1 mm or more.

Immediately after the engine 2 is stopped, the condensed water in the intake port 8 is adhered to the wall surface of the intake port 8. Soon, when the intake port 8 is cooled according to a lapse of time, the generation of condensed water progresses and the condensed water drips down to the intake valve 12 along the wall surface of the intake port 8. At this time, in the intake valve 12 of the first cylinder #1 that is open, the condensed water drips down from the gap into the cylinder. However, in a case where the amount of condensed water is large, water droplets adhere to the valve seat or the valve face. On the other hand, in the intake valves 12 of the second cylinder #2 and the third cylinder #3 that are closed, a liquid pool of the condensed water is formed on the valve head.

In a case where the temperature around the intake valve 12 falls below the freezing point in the state as described above, the condensed water freezes, and thus in the first cylinder #1, the closing failure of the intake valve 12 is caused by the ice formed in the gap between the valve seat and the valve face. Further, in the second cylinder #2 and the third cylinder #3, in a case where a large amount of condensed water is accumulated on the valve head, the passage for the intake air is blocked by the ice. In the example of the anti-freezing operation shown here, in a case where there is a possibility that the condensed water may freeze, the engine 2 is rotated by one cycle, that is, by 720 degrees by the motor 20. Accordingly, in the first cylinder #1, the water droplets adhered to the valve seat or the valve face disappear by being squashed when the intake valve 12 is temporarily closed. In the second cylinder #2 and the third cylinder #3, the condensed water accumulated on the valve head drips down when the intake valve 12 is temporarily opened, and at that time, the water droplets adhered to the valve seat or the valve face disappear by being squashed when the intake valve 12 closes again.

In a case where the engine 2 that is being stopped is rotated by the motor 20, abnormal noise is generated from the engine 2 that is stopped. There is a possibility that the abnormal noise from the engine 2, which should be stopped, may surprise the surrounding people. Therefore, it is desirable that the engine speed in a case where the engine 2 is rotated by the motor 20 is extremely low (for example, about 100 rpm). By suppressing the engine speed low, it is possible to sufficiently secure a time for compressed gas to leak out of the cylinder in the compressed cylinder, and to sufficiently secure a gas inflow time in the expanded cylinder. Therefore, by reducing compression work and expansion work, energy consumption for the anti-freezing operation can also be reduced as much as possible.

Figure 5:
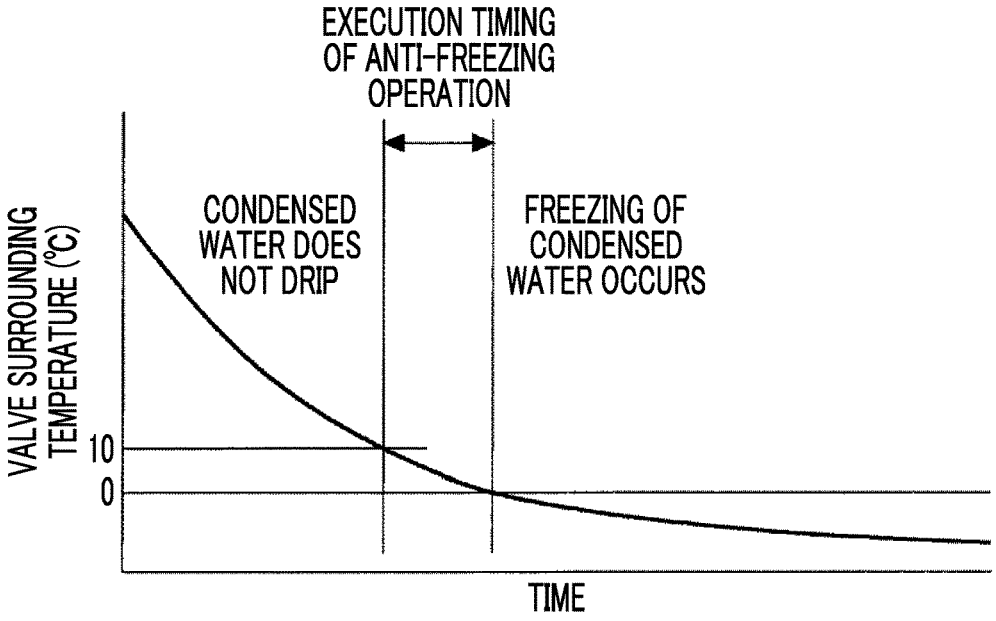
FIG. 5 is a graph showing an execution timing of the anti-freezing operation.

The control device 30 executes the anti-freezing operation as exemplified above, before the temperatures around the valves 12, 14 fall below the freezing point. FIG. 5 is a graph showing an execution timing of the anti-freezing operation. As shown in FIG. 5, after the surrounding temperature of the intake valve 12 has fallen below the freezing point, freezing already starts, and therefore, as the timing for executing the anti-freezing operation, it is too late. On the other hand, in a case where the elapsed time from the stop of the engine 2 is too short, the condensed water has not sufficiently dripped to the valves 12, 14, and therefore, even in a case where the anti-freezing operation is executed, there is no effect. Therefore, as the timing of executing the anti-freezing operation, it is preferable that the anti-freezing operation is executed after the condensed water has sufficiently dripped to the valves 12, 14 and before the surrounding temperature of the intake valve 12 falls below the freezing point.

In a case where an attempt to measure the execution timing of the anti-freezing operation, based on the surrounding temperature of the intake valve 12, is made, a timing when the surrounding temperatures of the valves 12, 14 become a temperature of 0° C.+$\alpha$ may be set as the execution timing. More specifically, the anti-freezing operation may be executed after the surrounding temperatures of the valves 12, 14 are lowered to a predetermined temperature range of lower than 10° C. The temperature of 10° C. that defines the predetermined temperature range is a temperature determined in consideration of an estimation error when estimating the surrounding temperatures of the valves 12, 14 (the temperature estimation will be described below). Therefore, in a case where the estimation error is small, the upper limit temperature of the predetermined temperature range may be lowered. The upper limit temperature of the predetermined temperature range is preferably a temperature lower than 5° C., more preferably a temperature lower than 3° C. Further, it is also possible to set a lower limit temperature in the predetermined temperature range. The lower limit temperature is preferably a freezing temperature (for example, 0° C.) of the condensed water.

5. Estimation of Valve Surrounding Temperature

Incidentally, the temperatures around the valves 12, 14 (hereinafter referred to as the valve surrounding temperature) cannot be directly measured unless a temperature sensor is provided around the valve. Due to the above, in order to determine the execution of the anti-freezing operation, it is needed to estimate the valve surrounding temperature, based on the relevant information. A method of estimating the valve surrounding temperature is not one, and there are several methods as disclosed below. A program for estimating the valve surrounding temperature by one of the following methods is incorporated into the control device 30. The program is executed by the processor, whereby the control device 30 functions as temperature estimating means.

A first method is a method of estimating the valve surrounding temperature from the outside air temperature that is measured by the outside air temperature sensor 32. After the engine 2 is stopped, the engine 2 is cooled by the outside air, and thus the temperature decreases. Due to the above, the valve surrounding temperature after the engine 2 is stopped is higher than the outside air temperature. In a case where the outside air temperature is equal to or higher than the freezing point when the engine 2 is stopped, when the valve surrounding temperature is regarded as a temperature higher than the outside air temperature by a predetermined temperature, when the outside air temperature has been lowered to a temperature near the freezing point, a decrease in the valve surrounding temperature to the predetermined temperature range can be detected.

Figure 6:
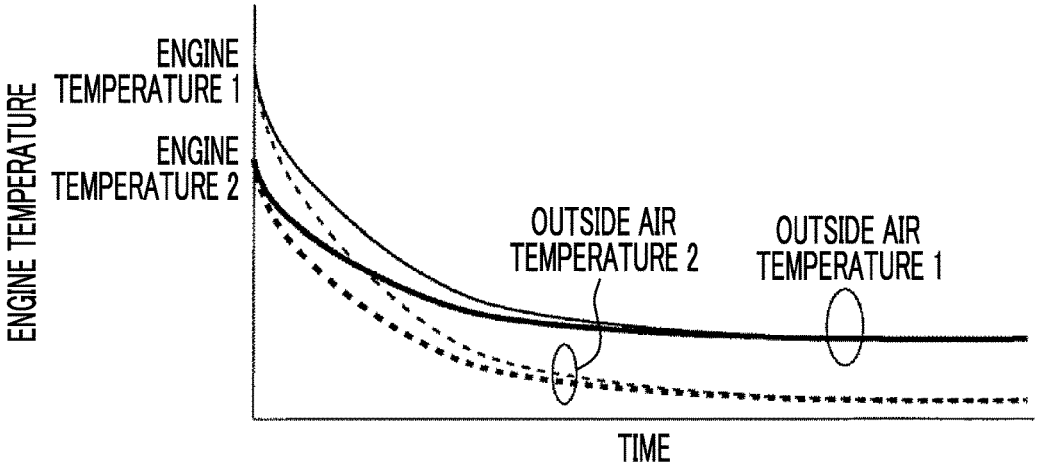
FIG. 6 is a graph showing a change in engine temperature according to the elapsed time after the stop of the internal combustion engine with respect to the respective combinations of a case where an engine temperature when the internal combustion engine is stopped is high and a case where the engine temperature when the internal combustion engine is stopped is low, and of a case where an outside air temperature is high and a case where the outside air temperature is low.

A second method is a method of estimating the valve surrounding temperature from the engine temperature when the engine is stopped, the outside air temperature that is measured by the outside air temperature sensor 32, and the elapsed time after the stop of the engine 2. FIG. 6 is a graph showing a change in engine temperature according to the elapsed time after the stop of the engine with respect to the respective combinations of a case where the engine temperature when the engine is stopped is relatively high (Engine Temperature 1) and a case where the engine temperature when the engine is stopped is relatively low (Engine Temperature 2), and of a case where the outside air temperature is relatively high (Outside Air Temperature 1) and a case where the outside air temperature is relatively low (Outside Air Temperature 2). As the engine temperature when the engine is stopped, the cooling water temperature when the engine is stopped, which is measured by the water temperature sensor 36, may be used. The engine temperature after the engine is stopped may be regarded as being equal to the valve surrounding temperature. In the second method, the valve surrounding temperature is estimated using a map in which the relationships shown in FIG. 6 are defined.

The relationship between the parameters shown in FIG. 6 can also be expressed by the following simple expression. The valve surrounding temperature may be estimated using the following expression instead of the map. Further, the estimated temperature in the following expression means an estimated temperature of the valve surrounding temperature, and the time constant in the following expression means a time constant per calculation period. The estimated temperature when n is 1, that is, the initial temperature is the engine temperature when the engine is stopped.

$$\text{Estimated temperature}(n)=\text{estimated temperature}(n-1)-\text{time constant}\times(\text{estimated temperature}(n-1)-\text{outside air temperature})$$

Figure 7:
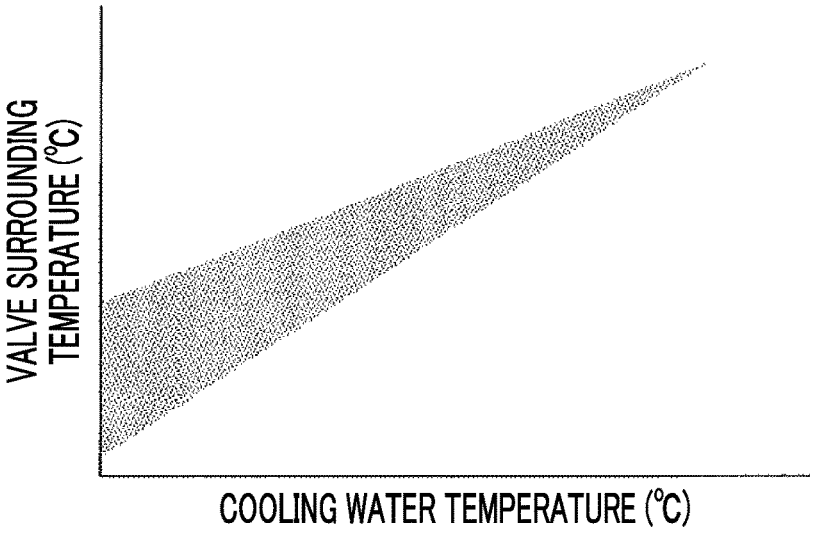
FIG. 7 is a graph showing a relationship between a cooling water temperature and a valve surrounding temperature.

A third method is a method of estimating the valve surrounding temperature from the cooling water temperature that is measured by the water temperature sensor 36. FIG. 7 is a graph showing the relationship between the cooling water temperature that is measured by the water temperature sensor 36 and the valve surrounding temperature. As shown in FIG. 7, there is an error between the cooling water temperature and the valve surrounding temperature, and the error becomes larger as the temperatures are lower. However, by using the median value, the lower limit value, or the like of an error range, it is possible to estimate the valve surrounding temperature from the cooling water temperature. In the third method, the valve surrounding temperature is estimated using a map in which the relationship between the cooling water temperature and the valve surrounding temperature is defined.

Figure 8:
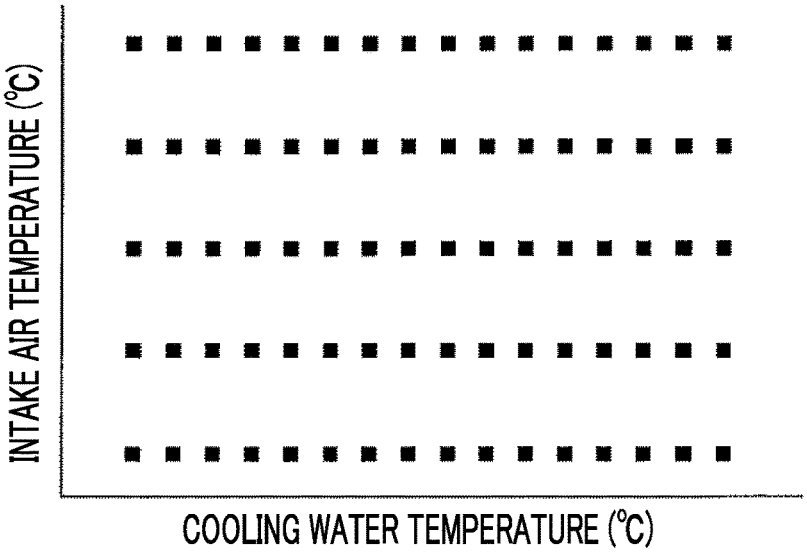
FIG. 8 is a graph showing an image of a map for estimating the valve surrounding temperature from an intake air temperature and a cooling water temperature.

A fourth method is a method of estimating the valve surrounding temperature, based on the cooling water temperature that is measured by the water temperature sensor 36 and the intake air temperature that is measured by the intake air temperature sensor 34. FIG. 8 is a graph showing an image of a map for estimating the valve surrounding temperature from the intake air temperature and the cooling water temperature. The valve surrounding temperature is stored for each coordinate that is defined by the intake air temperature and the cooling water temperature. In the fourth method, the valve surrounding temperature is estimated using the map as shown in FIG. 8.

6. Procedure for Anti-Freezing Control

Figure 9:
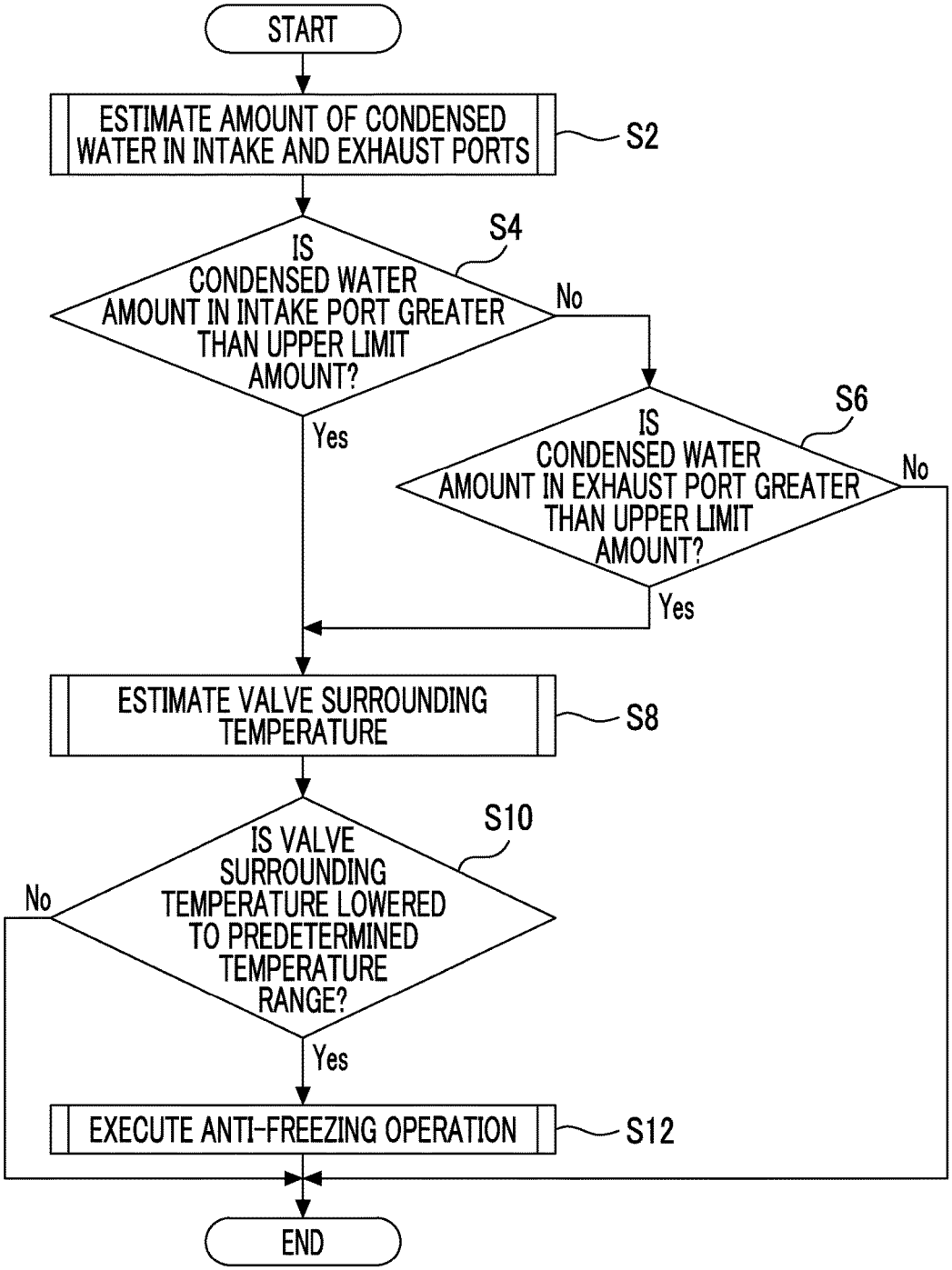
FIG. 9 is a flowchart showing a control flow of anti-freezing control.

As described above, the program for executing the anti-freezing operation and the program for estimating the valve surrounding temperature are incorporated into the control device 30. The programs described above are executed as a subroutine of anti-freezing control that is a main routine. The anti-freezing control is a program that is executed by the control device 30 at a constant period after the engine 2 is stopped, and a control flow thereof is represented by the flowchart of FIG. 9.

As shown in the flowchart, the anti-freezing control is composed of six steps. In step S2, estimation of the amount of condensed water in the intake port 8 and the amount of condensed water in the exhaust port 10 is performed. In the estimation of the amount of condensed water in the intake port 8, the intake port 8 is divided into a plurality of circular rings in the flow direction of intake air, and the amount of condensed water is calculated from the wall surface temperature and the dew point of gas for each circular ring. The calculation of the amount of condensed water is performed in order from an upstream portion of the intake port 8 to the combustion chamber 6. In the estimation of the amount of condensed water in the exhaust port 10, the exhaust port 10 is divided into a plurality of circular rings in the flow direction of exhaust air, and the amount of condensed water is calculated from the wall surface temperature and the dew point of gas for each circular ring. The calculation of the amount of condensed water is performed in order from a downstream portion of the exhaust port 10 to the combustion chamber 6.

In step S4, whether or not the amount of condensed water in the intake port 8 exceeds a predetermined upper limit amount is determined. In step S6, whether or not the amount of condensed water in the exhaust port 10 exceeds a predetermined upper limit amount is determined. The upper limit amount that is used in the determinations in steps S4 and S6 is the upper limit value of the amount of condensed water at which non-execution of the anti-freezing operation is allowed, and specifically, the upper limit amount is an amount less than 0.1 cc that is the second reference amount. In a case where both the determination result in step S4 and the determination result in step S6 are No, all subsequent processing is skipped. The problem in that the condensed water freezes in the gap between the valve face and the valve seat does not occur in a case where the amount of condensed water is equal to or less than the predetermined upper limit amount. Therefore, in a case where the amount of condensed water is equal to or less than the upper limit amount, the anti-freezing operation is not executed, whereby energy consumption can be suppressed as much as possible.

In a case where at least one of the determination result in step S4 and the determination result in step S6 is Yes, the processing of step S8 is performed. In step S8, the valve surrounding temperature is estimated by the method described above. In step S10, whether or not the valve surrounding temperature estimated in step S8 has been lowered to a predetermined temperature range that is higher than 0° C. and lower than 10° C. is determined. In a case where the determination result in step S10 is No, it is not needed to execute the anti-freezing operation, and therefore, the subsequent processing is skipped.

In a case where the determination result in step S10 is Yes, the anti-freezing operation is executed in step S12. The anti-freezing operation is performed on at least the intake valve 12 in a case where the amount of condensed water in the intake port 8 exceeds the upper limit amount, and performed on at least the exhaust valve 14 in a case where the amount of condensed water in the exhaust port 10 exceeds the upper limit amount. The anti-freezing operation is executed, whereby the condensed water that is generated after the engine 2 is stopped is restrained as much as possible from being frozen in the gap between the valve face and the valve seat of each of the valves 12, 14.

7. Modification Examples of Anti-Freezing Operation

In the case of the engine that is driven by the motor as in this embodiment, by controlling the rotation direction of the motor, it is possible to switch the rotation direction of the engine at the time of the stop from forward rotation to reverse rotation, or from reverse rotation to forward rotation. The combinations of the switching of the rotation direction of the engine with the anti-freezing operation are Modification Example 1 of the anti-freezing operation shown in FIG. 10 and Modification Example 2 of the anti-freezing operation shown in FIG. 11. However, the engine in Modification Examples 1, 2 is an in-line four-cylinder engine.

Figure 10:
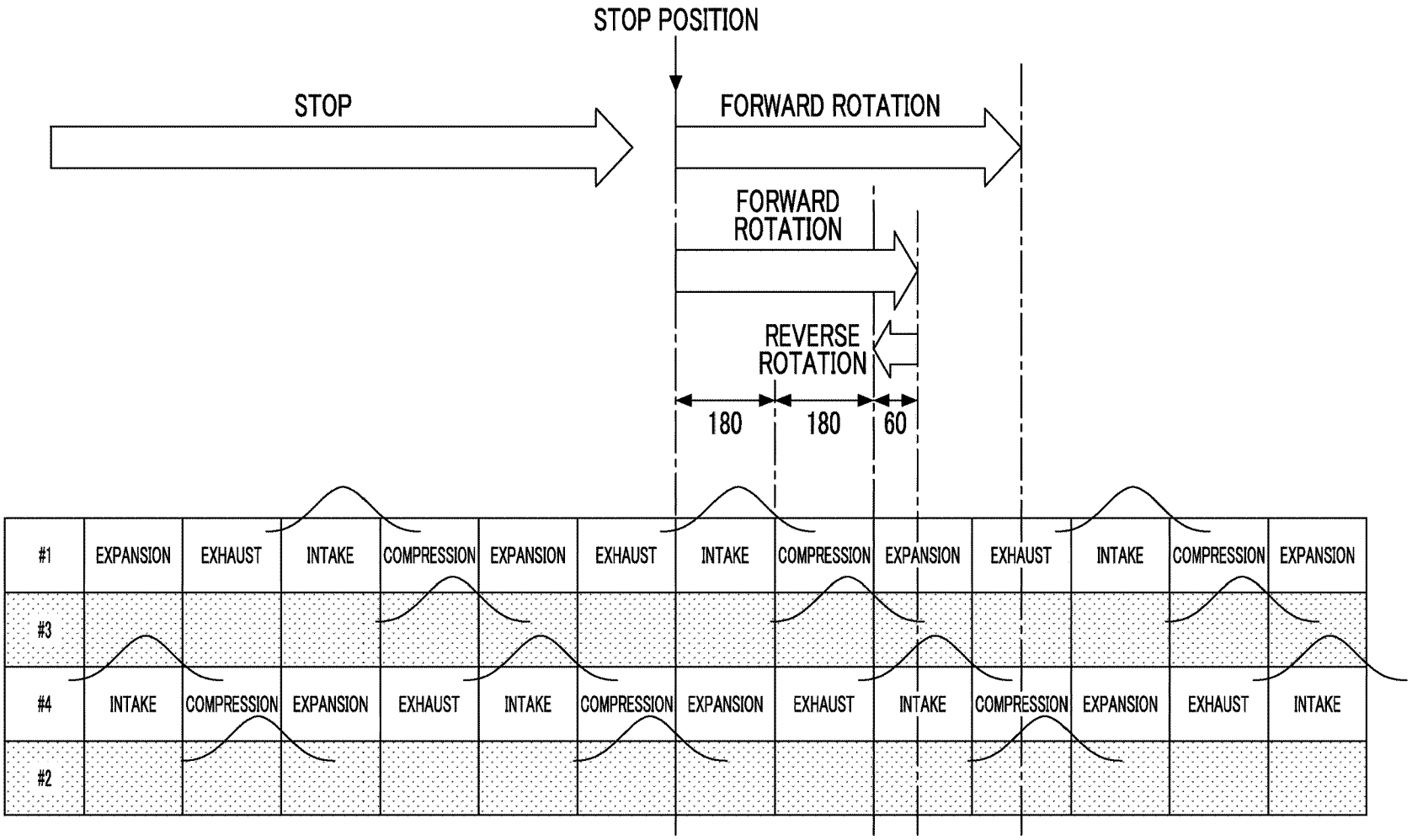
FIG. 10 is a diagram showing Modification Example 1 of the anti-freezing operation.

In Modification Example 1 of the anti-freezing operation shown in FIG. 10, after the engine is forwardly rotated by 420 degrees, the engine is reversely rotated by 60 degrees. That is, the engine is rotated by 480 degrees in total. With the operation described above, the intake valve that has been opened when the engine is stopped is temporarily closed and then opened again, and the intake valve that has been closed when the engine is stopped is temporarily opened and then closed again. In a case where the same intake valve operation is realized solely by the forward rotation of the engine, in the example shown in FIG. 10, it is needed to rotate the engine by at least 630 degrees. Therefore, according to Modification Example 1 of the anti-freezing operation, by reducing the amount of rotation of the engine, it is possible to further suppress the occurrence of abnormal noise and to suppress energy consumption as much as possible.

Figure 11:
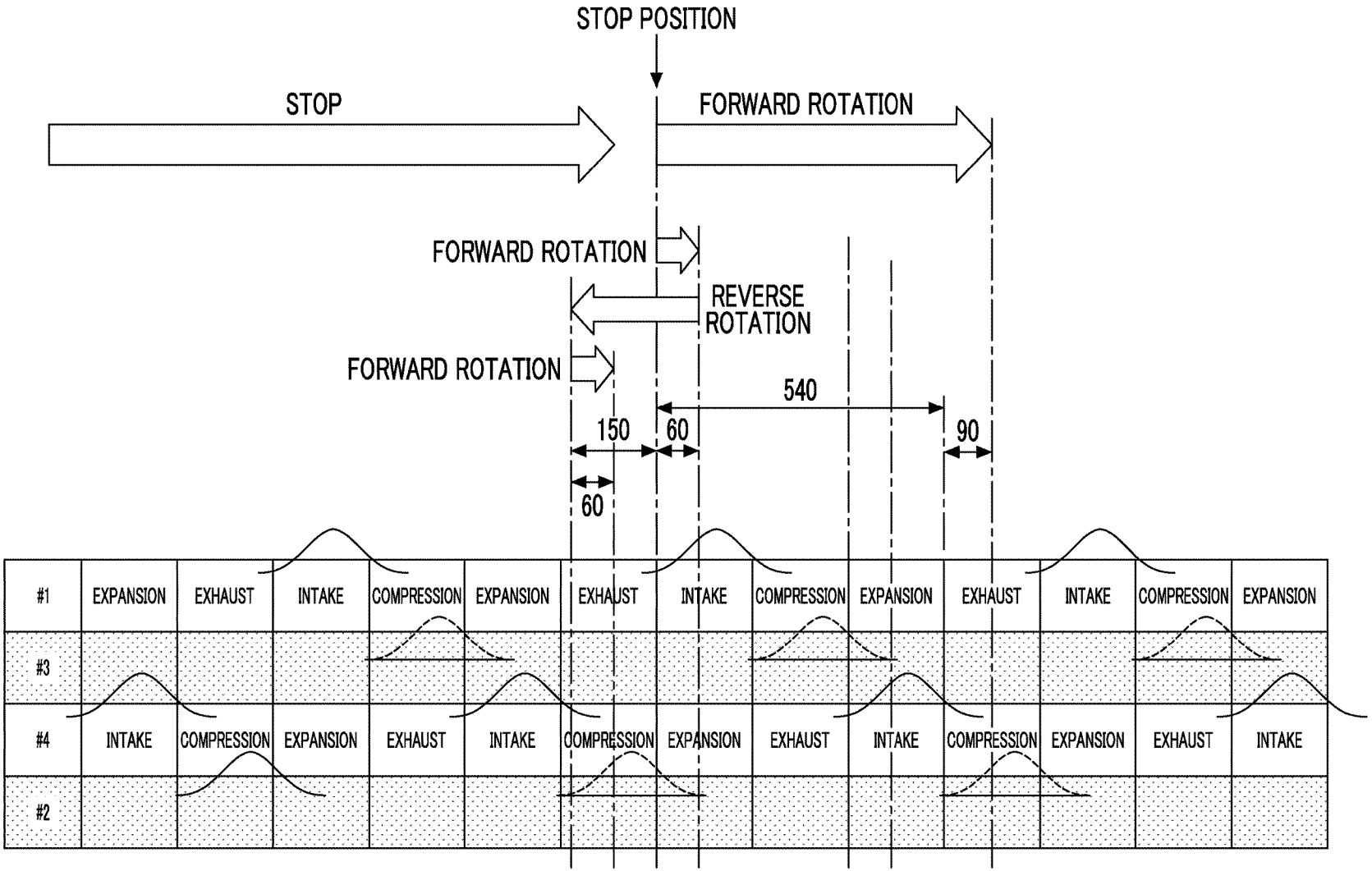
FIG. 11 is a diagram showing Modification Example 2 of the anti-freezing operation.

In Modification Example 2 of the anti-freezing operation shown in FIG. 11, due to a cylinder stopping operation on the variable valve drive mechanism, the intake valves of the second cylinder #2 and the fourth cylinder #4 are maintained to be fully closed. Then, in a state where solely the intake valves of the first cylinder #1 and the third cylinder #3 move, the engine is forwardly rotated by 60 degrees, then reversely rotated by 210 degrees, and forwardly rotated by 60 degrees. That is, the engine is rotated by 330 degrees in total. With the operation described above, the intake valves of the first cylinder #1 and the third cylinder #3, which have been closed when the engine is stopped, are temporarily opened and then closed again. In a case where the same intake valve operation is realized solely by the forward rotation of the engine, in the example shown in FIG. 11, it is needed to rotate the engine by at least 630 degrees. Therefore, according to Modification Example 2 of the anti-freezing operation, by reducing the amount of rotation of the engine, it is possible to further suppress occurrence of abnormal noise and to suppress energy consumption as much as possible.

8. Other Embodiments

The control device can have a communication function with the outside, for example, a communication function with an external server through connection to the Internet. In the case described above, in a case where a weather information providing service from the external server is used, it is possible to acquire prediction of a change in the outside air temperature after the engine is stopped. In a case where it is possible to predict how the outside air temperature will change in the future, it is possible to determine the possibility of freezing after the engine is stopped, based on the prediction. In a case where the estimation of the valve surrounding temperature after the engine is stopped is performed solely in a case where a determination that there is the possibility of freezing is made, the control device does not need to continue to run the estimation program after the engine is stopped, and thus energy consumption can be reduced as much as possible.

Further, the possibility of freezing after the engine is stopped may be determined from the learning result. For example, in a case where the valve surrounding temperature after a prolonged stop of the engine, preferably, the valve surrounding temperature at the time of restarting is stored and lowering of the valve surrounding temperature to the predetermined temperature range is continued by a predetermined number of times, a determination that there is a possibility of freezing even when the engine is stopped next may be made. Alternatively, a stop pattern classified for each vehicle position (for example, altitude or latitude and longitude) at each time when the engine is stopped is created, a valve surrounding temperature after the engine is stopped is learned for each stop pattern, and the possibility of freezing when the engine is stopped next may be determined for each stop pattern.

As a modification example, the possibility of freezing after the engine is stopped may be determined solely by the outside air temperature when the engine is stopped. Specifically, in a case where the outside air temperature when the engine is stopped is equal to or lower than a predetermined temperature, a determination that during the subsequent stop of the engine, there is a possibility that the valve surrounding temperature may be lowered to a temperature equal to or lower than 0° C. may be made. In a case where the outside air temperature when the engine is stopped is already equal to or lower than 0° C., it is obvious that the valve surrounding temperature will soon also become equal to or lower than 0° C. Therefore, the predetermined temperature that is a criterion for determination may be set to a temperature equal to or lower than 0° C., for example.

However, even in a case where the outside air temperature when the engine is stopped is higher than 0° C., there is a possibility that the outside air temperature may become equal to or lower than 0° C. thereafter. The possibility described above increases as the outside air temperature when the engine is stopped is closer to 0° C. Therefore, in order not to mistakenly determine that the valve surrounding temperature becomes equal to or lower than 0° C. after the engine is stopped, it is preferable that the predetermined temperature that is a criterion for determination is a temperature higher than 0° C. On the other hand, in order to suppress energy consumption due to performing an unnecessary anti-freezing operation as much as possible, it is favorable that the predetermined temperature that is a criterion for determination is not too high, and the predetermined temperature is preferably a temperature lower than 5° C. The temperature of 5° C. in the case described above is a limit value of the predetermined temperature, and therefore, for example, whether or not the outside air temperature when the engine is stopped is a temperature lower than 5° C. may be determined. In a case where the measurement precision of the temperature sensor for measuring the outside air temperature is relatively high, a temperature lower than 3° C. may be set as the predetermined temperature.

In a case where the possibility of freezing after the engine is stopped is determined solely by the outside air temperature when the engine is stopped, it is preferable that the anti-freezing operation is executed at a timing when the engine stops, alternatively, the anti-freezing operation is executed after a predetermined time has elapsed from the stop of the engine. Hereinafter, the anti-freezing control that is executed at the condition and timing of the former is referred to as anti-freezing control according to a first modification example, and the anti-freezing control that is executed at the condition and timing of the latter is referred to as anti-freezing control according to a second modification example.

Figure 12:
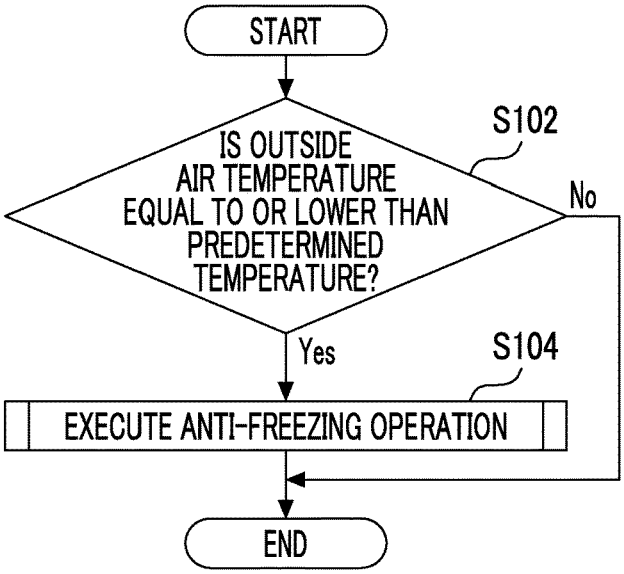
FIG. 12 is a flowchart showing a control flow of anti-freezing control according to a first modification example.

FIG. 12 is a flowchart showing a control flow of the anti-freezing control according to the first modification example. The anti-freezing control shown in FIG. 12 is executed at a timing when the condition of an engine stop request is satisfied and an engine stop operation is started. First, in step S102 that is the first processing, the outside air temperature at the point in time when the engine stop operation is started is measured by a temperature sensor. Then, whether or not the measured outside air temperature is equal to or lower than a predetermined temperature is determined. When the outside air temperature is higher than the predetermined temperature, the anti-freezing operation is not performed. An unnecessary anti-freezing operation is not performed, whereby energy consumption can be suppressed as much as possible.

In a case where the outside air temperature is equal to or lower than the predetermined temperature, the processing of step S104 is performed. In step S104, the anti-freezing operation is performed within a period until the stop of the engine is completed. Here, the stop position control of the engine is used for the anti-freezing operation. Specifically, a stopping crank angle of the engine is controlled such that the valve is fully closed or is in a state of being opened with the lift amount of 1 mm or more. There is no limitation on a method of controlling the stop position of the engine. For example, the stopping crank angle may be controlled by a fuel cut timing, or the stopping crank angle may be controlled by controlling a load on an auxiliary machine or the like.

In a case where the anti-freezing operation is performed after the engine is stopped, it is needed to drive the valve by rotating the crankshaft with the motor or the like. That is, it is needed to input energy for the anti-freezing operation. However, according to the anti-freezing control according to the first modification example, the anti-freezing operation is performed by the stop position control before the engine completely stops, whereby the kinetic energy of the engine can be used for the anti-freezing operation. Further, a corresponding burden is applied to the control device in order to accurately execute the stop position control. However, the anti-freezing operation by the stop position control is limited to a case where the outside air temperature when the engine is stopped is equal to or lower than the predetermined temperature, and therefore, the burden of the control device associated with the anti-freezing control is further suppressed.

Figure 13:
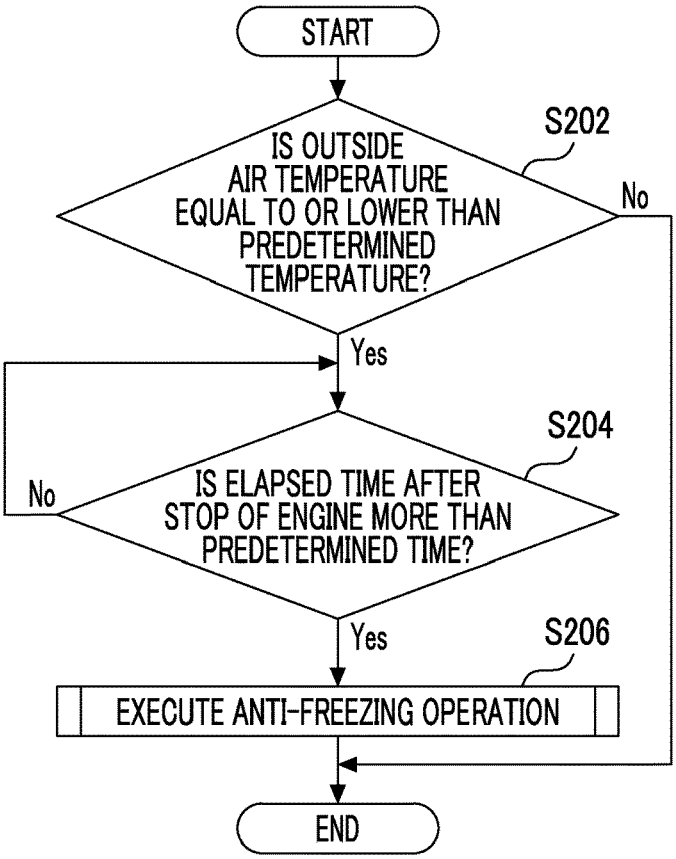
FIG. 13 is a flowchart showing a control flow of anti-freezing control according to a second modification example.

FIG. 13 is a flowchart showing a control flow of the anti-freezing control according to the second modification example. The anti-freezing control shown in FIG. 13 is also executed at a timing when the condition of the engine stop request is satisfied and the engine stop operation is started. First, in step S202 that is the first processing, the outside air temperature at the point in time when the engine stop operation is started is measured by a temperature sensor. Then, whether or not the measured outside air temperature is equal to or lower than a predetermined temperature is determined. When the outside air temperature is higher than the predetermined temperature, the anti-freezing operation is not performed.

In a case where the outside air temperature is equal to or lower than the predetermined temperature, the determination in step S204 is performed. In step S204, whether or not the elapsed time from the stop of the engine has exceeded a predetermined time is determined. Then, until the elapsed time exceeds the predetermined time, the anti-freezing operation is not performed and enters a standby state. After the engine is stopped, condensed water that is generated due to a decrease in the temperature in the port, or condensed water flowing to the port due to free fall is also present considerably. The predetermined time that is a criterion for determination is a time (for example, one hour) needed for a certain amount of condensed water to flow to the periphery of the valve.

In a case where the elapsed time from the stop of the engine has exceeded the predetermined time, the anti-freezing operation by driving the valve by rotating the crankshaft with the motor or the like is performed. Here, the valve that has been opened when the engine is stopped is fully closed, and the valve that has been fully closed when the engine is stopped is opened with the lift amount of 1 mm or more. With the operation described above, the condensed water accumulated on the valve head in the port drops into the cylinder from the gap between the valve face and the valve seat, which is formed when the valve is opened. The valve that has been fully closed when the engine is stopped may be opened at least once and then fully closed. The valve that is in a fully closed state is temporarily opened, whereby the condensed water accumulated on the valve head in the port drops into the cylinder from the gap between the valve face and the valve seat, which is formed when the valve is opened. By fully closing the opened valve again, the water droplets adhered to the valve seat or the valve face are squashed and removed.

According to the anti-freezing control according to the second modification example, although it is needed to drive the valve after the engine is stopped, it is possible to further restrain the condensed water generated in the port or dripping down to the port after the engine is stopped from accumulating around the valve. The timing at which the anti-freezing operation is executed can be measured with a timer, and therefore, as compared with a case where the valve surrounding temperature is continuously estimated after the engine is stopped as in the embodiment described above, the burden of the control device associated with the anti-freezing control is further suppressed.

Incidentally, in a case where the vehicle is a so-called plug-in hybrid vehicle, there is a possibility that the condensed water may freeze in the stopped engine in a case where the traveling by the motor continues for a long time. The present disclosure can also be applied to the plug-in hybrid vehicle. However, preferably, the anti-freezing operation of the engine when the vehicle is stopped is prohibited and the anti-freezing operation is executed during the traveling by the motor. This is because during the traveling by the motor, even in a case where abnormal noise is generated from the stopped engine due to the anti-freezing operation, it is unlikely to make the occupant or the surrounding people nervous.

In the embodiments described above, the variable valve drive mechanism is a mechanical type. However, the variable valve drive mechanism may be an electric type. As long as it is an electric type variable valve drive mechanism that directly drives the valve by an electromagnetic coil or a motor, it is possible to execute the opening and closing operation of the valve in the anti-freezing operation without rotating the engine.

What is claimed is:

1. A control device for an internal combustion engine including combustion chambers, ports connected to the combustion chambers, and valves configured to open and close areas between the combustion chambers and the ports, the control device comprising:

an electronic control unit configured to execute an anti-freezing operation of performing control to fully close the valves or make the valves be in a state of being opened with a lift amount of 1 mm or more, in a case where temperatures around the valves are lowered to a predetermined temperature range after the internal combustion engine is stopped, or in a case where an outside air temperature when the internal combustion engine is stopped is equal to or lower than a predetermined temperature, wherein:

the predetermined temperature range is a temperature range in which an upper limit value is lower than 10° C.; and the predetermined temperature is lower than 5° C., wherein:

the electronic control unit is configured to perform control to fully close the valves, as the anti-freezing operation, in a case where the valves are opened before the temperatures around the valves are lowered to the predetermined temperature range; and the electronic control unit is configured to perform control to open the valves with a lift amount of 1 mm or more, as the anti-freezing operation, in a case where the valves are fully closed before the temperatures around the valves are lowered to the predetermined temperature range.

2. The control device according to claim 1, wherein the electronic control unit is configured to perform control to open the valves at least once and then fully close the valves, as the anti-freezing operation, in a case where the valves are fully closed before the temperatures around the valves are lowered to the predetermined temperature range.

3. The control device according to claim 1, wherein the electronic control unit is configured to execute the anti-freezing operation at a timing when the internal combustion engine is stopped, in a case where the outside air temperature when the internal combustion engine is stopped is equal to or lower than the predetermined temperature.

4. The control device according to claim 1, wherein the electronic control unit is configured to estimate the temperatures around the valves, based on an outside air temperature.

5. The control device according to claim 4, wherein:

the electronic control unit is configured to determine a possibility of freezing after the internal combustion engine is stopped, based on information obtained by communication with the outside; and the electronic control unit is configured to estimate the temperatures around the valves after the internal combustion engine is stopped, solely in a case where the electronic control unit determines that there is a possibility of freezing.

6. The control device according to claim 1, wherein the electronic control unit is configured to estimate the temperatures around the valves, based on an engine temperature when the internal combustion engine is stopped, an outside air temperature, and an elapsed time after the stop of the internal combustion engine.

7. The control device according to claim 1, wherein the electronic control unit is configured to estimate the temperatures around the valves, based on outputs of temperature sensors provided inside the internal combustion engine.

8. A control device for an internal combustion engine including combustion chambers, ports connected to the combustion chambers, and valves configured to open and close areas between the combustion chambers and the ports, the control device comprising:

an electronic control unit configured to execute an anti-freezing operation of performing control to fully close the valves or make the valves be in a state of being opened with a lift amount of 1 mm or more, in a case where temperatures around the valves are lowered to a predetermined temperature range after the internal combustion engine is stopped, or in a case where an outside air temperature when the internal combustion engine is stopped is equal to or lower than a predetermined temperature, wherein:

the predetermined temperature range is a temperature range in which an upper limit value is lower than 10° C.; and the predetermined temperature is lower than 5° C., wherein:

the electronic control unit is configured to perform control to fully close the valves, as the anti-freezing operation, after a predetermined time has elapsed from the stop of the internal combustion engine, in a case where the outside air temperature when the internal combustion engine is stopped is equal to or lower than the predetermined temperature and the valves are opened when the internal combustion engine is stopped; and the electronic control unit is configured to perform control to open the valves with a lift amount of 1 mm or more, as the anti-freezing operation, after a predetermined time has elapsed from the stop of the internal combustion engine, in a case where the outside air temperature when the internal combustion engine is stopped is equal to or lower than the predetermined temperature and the valves are fully closed when the internal combustion engine is stopped.

9. The control device according to claim 8, wherein the electronic control unit is configured to perform control to open the valves at least once and then fully close the valves, as the anti-freezing operation after a predetermined time has elapsed from the stop of the internal combustion engine, in a case where the outside air temperature when the internal combustion engine is stopped is equal to or lower than the predetermined temperature and the valves are fully closed when the internal combustion engine is stopped.

10. A control device for an internal combustion engine including combustion chambers, ports connected to the combustion chambers, and valves configured to open and close areas between the combustion chambers and the ports, the control device comprising:

an electronic control unit configured to execute an anti-freezing operation of performing control to fully close the valves or make the valves be in a state of being opened with a lift amount of 1 mm or more, in a case where temperatures around the valves are lowered to a predetermined temperature range after the internal combustion engine is stopped, or in a case where an outside air temperature when the internal combustion engine is stopped is equal to or lower than a predetermined temperature, wherein:

the predetermined temperature range is a temperature range in which an upper limit value is lower than 10° C.; and the predetermined temperature is lower than 5° C., wherein:

the electronic control unit is configured to estimate an amount of condensed water that is present in the ports when the internal combustion engine is stopped or after the internal combustion engine is stopped; and the electronic control unit is configured to change control of the valves according to the amount of the condensed water, as the anti-freezing operation.

11. The control device according to claim 10, wherein the electronic control unit is configured to execute the anti-freezing operation in a case where the amount of the condensed water is greater than a predetermined upper limit amount.

12. The control device according to claim 11, wherein:

the electronic control unit is configured to perform control to fully close the valves or make the valves be in a state of being opened with a lift amount of 1 mm or more, as the anti-freezing operation, in a case where the amount of the condensed water is greater than the upper limit amount and equal to or less than a first reference amount that is greater than the upper limit amount; and the electronic control unit is configured to perform control to open the valves at least once and then fully close the valves, as the anti-freezing operation, in a case where the amount of the condensed water is greater than the first reference amount.

13. The control device according to claim 12, wherein the electronic control unit is configured to perform control to fully close the valves, as the anti-freezing operation, in a case where the amount of the condensed water is equal to or less than the first reference amount and is greater than a second reference amount smaller than the first reference amount.

14. A control device for an internal combustion engine including combustion chambers, ports connected to the combustion chambers, and valves configured to open and close areas between the combustion chambers and the ports, the control device comprising:

an electronic control unit configured to execute an anti-freezing operation of performing control to fully close the valves or make the valves be in a state of being opened with a lift amount of 1 mm or more, in a case where temperatures around the valves are lowered to a predetermined temperature range after the internal combustion engine is stopped, or in a case where an outside air temperature when the internal combustion engine is stopped is equal to or lower than a predetermined temperature, wherein:

the predetermined temperature range is a temperature range in which an upper limit value is lower than 10° C.; and the predetermined temperature is lower than 5° C., wherein:

the internal combustion engine has valves having different mounting angles with respect to a horizontal plane; and the electronic control unit is configured to make control of the valves different according to the mounting angles, as the anti-freezing operation.

* * * * *